US009609406B2

(12) United States Patent
Guo et al.

(10) Patent No.: US 9,609,406 B2
(45) Date of Patent: Mar. 28, 2017

(54) SPEAKER SYSTEM

(71) Applicant: PUMA SE, Herzogenaurach (DE)

(72) Inventors: Feng Guo, Nanshan District (CN); Bo Wang, Nanshan District (CN); Dengfeng Cao, Nanshan District (CN); Xueping Xiao, Nanshan District (CN); Xinhua He, Nanshan District (CN)

(73) Assignee: PUMA SE, Herzogenaurach (DE)

( * ) Notice: Subject to any disclaimer, the term of this patent is extended or adjusted under 35 U.S.C. 154(b) by 25 days.

(21) Appl. No.: 14/397,072

(22) PCT Filed: Apr. 1, 2014

(86) PCT No.: PCT/CN2014/074549

§ 371 (c)(1),
(2) Date: Oct. 24, 2014

(87) PCT Pub. No.: WO2014/161475

PCT Pub. Date: Oct. 9, 2014

(65) Prior Publication Data

US 2015/0139464 A1 May 21, 2015

Related U.S. Application Data

(60) Provisional application No. 61/895,525, filed on Oct. 25, 2013.

(30) Foreign Application Priority Data

Apr. 1, 2013 (CN) ..... 2013 1 0111136

(51) Int. Cl.
*H04R 1/02* (2006.01)
*H04R 1/04* (2006.01)

(52) U.S. Cl.
CPC ..... *H04R 1/02* (2013.01); *H04R 1/025* (2013.01); *H04R 1/04* (2013.01)

(58) Field of Classification Search
CPC ..... G06K 9/46; G06K 9/4604; G06T 7/20; H04R 1/02; H04R 1/025; H04R 1/04
(Continued)

(56) References Cited

U.S. PATENT DOCUMENTS 5,191,177 A * 3/1993 Chi ..... B60R 11/0217 181/153
7,242,785 B2 * 7/2007 McNary ..... H04R 1/2811 381/182
(Continued)

FOREIGN PATENT DOCUMENTS

CN 201146590 Y 11/2008
CN 201219303 Y 4/2009
(Continued)

OTHER PUBLICATIONS

International Search Report mailed on Jun. 25, 2014, for International Patent Application No. PCT/CN2014/074549, and with Written Opinion filed Apr. 1, 2014 (10 pages).
(Continued)

*Primary Examiner* — Hemant Patel
(74) *Attorney, Agent, or Firm* — Brown Rudnick LLP; Mark S. Leonardo

(57) ABSTRACT

Devices of the invention are portable speakers that provide stereophonic, surround sound. According to certain aspects, a speaker system includes a first speaker portion, a second speaker portion and a cable handle. The first speaker portion includes a first end and a second end, and the second speaker portion includes a third end and a fourth end. The cable handle couples the first end of the first speaker portion and a third end of the second speaker portion. The second end of
(Continued)

the first speaker portion is configured to releasably couple to the fourth end of the second speaker portion, thereby forming a looped unit, when coupled, with the first speaker portion, the second speaker portion, and the cable handle.

20 Claims, 12 Drawing Sheets

(58) Field of Classification Search
USPC ..... 381/335
See application file for complete search history.

(56) References Cited

U.S. PATENT DOCUMENTS 9,237,395 B2* 1/2016 Sze ..... H04R 1/1033
2007/0253580 A1* 11/2007 Sutton ..... A47G 9/1045 381/124
2008/0187166 A1* 8/2008 Ko ..... H04R 5/023 381/388
2010/0002898 A1* 1/2010 Murray ..... H04R 5/02 381/334
2012/0314894 A1* 12/2012 Lund ..... H04R 1/028 381/334

FOREIGN PATENT DOCUMENTS

CN 201594896 U 9/2010
CN 201766692 U 3/2011
CN 203181199 U 9/2013

OTHER PUBLICATIONS

English abstract of CN 203027408 U, obtained online on Mar. 24, 2015 (1 page).

* cited by examiner

SPEAKER SYSTEM

CROSS REFERENCE TO RELATED APPLICATIONS

The present application is a National Stage Entry of International Patent Application No. PCT/CN2014/074549, filed Apr. 1, 2014, which claims the benefit of and priority to Chinese Patent Application No. 201310111136.5, filed Apr. 1, 2013, and U.S. Provisional Application No. 61/895,525, filed Oct. 25, 2013. The aforementioned applications are incorporated by reference herein.

FIELD OF INVENTION

This application generally relates to a transportable and convertible speaker system.

BACKGROUND OF THE INVENTION

Technological advances in portable media devices have created a demand for portable speakers for use with the portable media devices. For example, smart phones, computer tablets, and laptops allow a user to access music, movies, etc. directly from a media device at any time and location. In order to maximize use of the media devices, portable speakers have emerged to provide sound on the go. Typical portable speakers are compact, single speaker devices that connect to the media devices via a cable or Bluetooth wireless technology.

In order to maintain portability, portable speakers are limited in the amount of speaker drivers and the location of the speaker drivers. These design constraints prevent speaker driver placement that allows for stereophonic, spatial sound, which limits sound quality. In addition, portable speakers are frequently sold as stand-alone units, without a carrying case or other means for simplifying their transportation. As a result, portable speakers tend to take a lot of physical abuse during transportation, and frequently are not capable of withstanding such abuse.

SUMMARY OF THE INVENTION

The invention provides a portable duel speaker system with enhanced sound quality and portability. Portable speaker systems of the invention include a first speaker portion coupled to a second speaker portion, in which the first and second speaker portions are separated by a distance in order to provide stereophonic, spatial sound. A duel speaker system of the invention resembles a nunchuck, in that the two speaker portions are coupled together at one end by a handle cable. The handle cable provides for easy carrying of the speakers and allows one to hang the speakers. The two separate speaker portions can also releasably couple to each other on the other end to form a compact looped unit for controlled carrying (i.e. without the separate speaker systems moving relative to each other). The compact looped configuration allows one to loop the speakers onto a backpack or bike. For example, the speakers can encircle a strap of a backpack, thereby allowing a user to transport the speakers without using their hands.

According to certain aspects, a speaker system of the invention includes a first portion, second portion, and a handle cable. The first portion includes a first speaker body and a first speaker driver disposed within the first speaker body. The first speaker body has a first distal end and a first proximal end. The second portion includes a second speaker body and a second speaker driver disposed within the second speaker body. The second speaker body has a second distal end and a second proximal end. The handle cable couples to the first distal end of the first portion to the second proximal end of the second portion. The first proximal end of the first portion releasably couples to second distal end of the second portion, thereby allowing the speaker system to convert from an open configuration, in which the first and second portions are separated by a distance, to a closed configuration, in which the first portion, second portion, and handle cable form a looped unit.

Portable duel speaker systems of the invention are designed to be used with any stationary or portable media device. Exemplary media devices include smartphones, laptops, computers, televisions, etc.

Speaker drivers for use in devices of the invention may include, for example cone, dome, or ribbon drivers. In addition, each portion of the portable speaker system may include one or more speaker drivers in various configurations. In one embodiment, a speaker driver is disposed at least partially within a speaker body and facing the end of the speaker body that is coupled to the cable handle. Alternatively, the speaker driver may face the opposite end of the speaker body or face a side of a speaker body.

According to certain embodiments, at least one of the speaker portions includes a passive radiator. Passive radiators utilize air outputted from the speaker drivers to transmit sound at low frequencies. Passive radiators may be anywhere within (or partially disposed within) a speaker body. In one embodiment, a passive radiator is directly across and facing the opposite direction than a speaker body.

According to certain aspects, a speaker system of the invention includes a main speaker portion, and an auxiliary speaker portion. The main speaker and the auxiliary speaker are magnetically attracted to each other, and a handle cable (i.e. handle portion) connects the main speaker to the auxiliary speaker. The main speaker includes a first shell, a first circuit board provided in the first shell, a first battery and a first loudspeaker. The first loudspeaker is provided at one side of the first circuit board, and a first passive radiation element is provided at the other side of the first circuit board and used for bass oscillation.

The auxiliary speaker includes a second shell, a second circuit board provided in the second shell, a second battery and a second loudspeaker. The second loudspeaker is provided at one side of the second circuit board, and a second passive radiation element is provided at the other side of the second circuit board and used for bass oscillation. The second circuit board receives an audio electronic signal transmitted by the first circuit board via the handle cable. In certain embodiments, the sound directions of the first loudspeaker and the second loudspeaker face towards the handle cable. The first passive radiation element may be magnetically coupled to or separated from the second passive radiation element.

DETAILED DESCRIPTION

Figure 1:
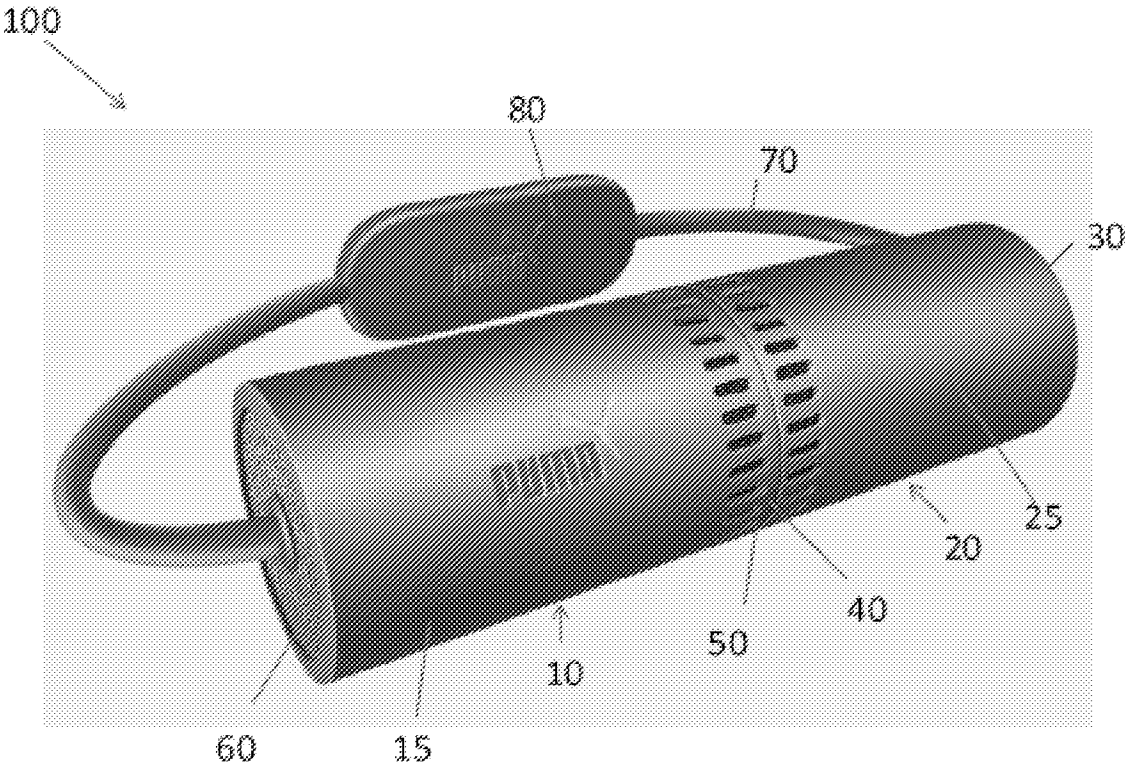
FIG. 1 depicts a portable speaker system of the invention in a closed configuration according to one embodiment.

FIG. 1 depicts a portable speaker system 100 of the invention. The portable speaker system may be used in a home or office environment, at the gym, outdoors, and when traveling, on the beach or at a hotel. The system 100 may be used in combination with a media device such as an audio or multimedia device. The media device may be portable or stationary. Exemplary media devices include for example, a CD players, televisions, DVD or VCD players, media players, tablets, laptops or notebook computers, personal digital assistants, or MP3 players (not shown). In certain embodiments, the materials and parts that form the speaker system are chosen so that the speaker system when fully assembled weighs less than one pound. This maximizes portability of the speaker system.

Figure 2:
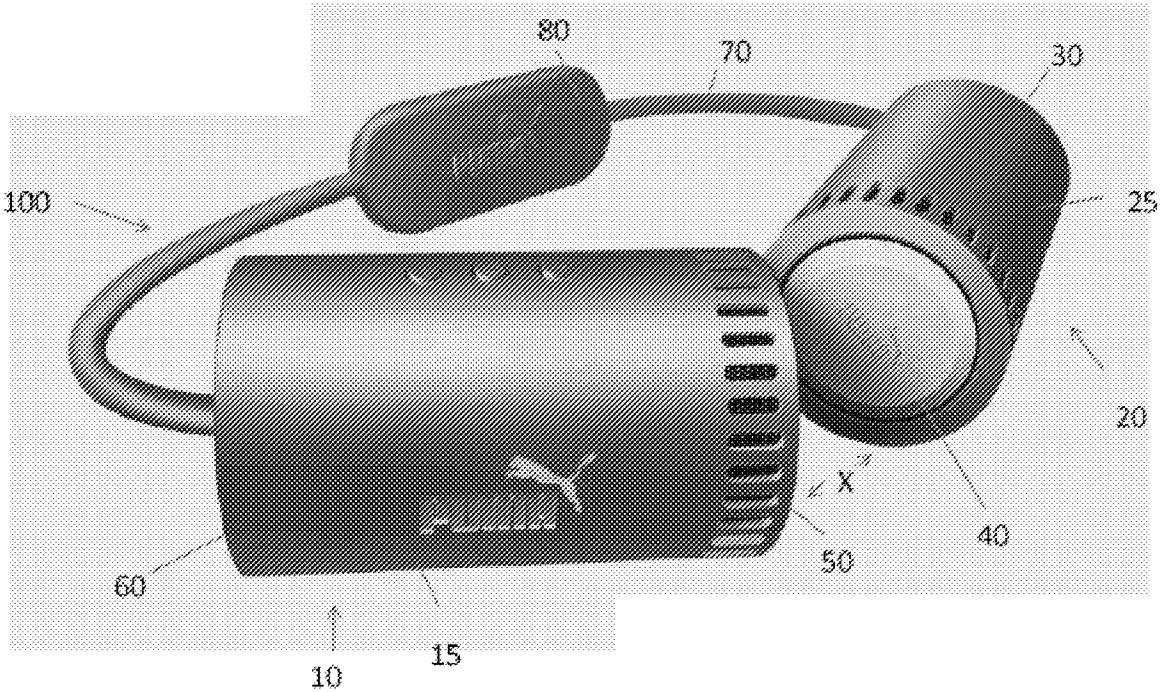
FIG. 2 depicts a portable speaker system of the invention in an open configuration according to one embodiment.

As shown in FIGS. 1 and 2, the portable speaker system 100 of the invention includes a first portion 10 coupled to a second portion 20 via a handle cable 70. The first portion 10 may be referred to herein as a main speaker, and the second portion may be referred to herein as an auxiliary speaker. The first portion 10 includes a speaker body 15 having a proximal end 50 and a distal end 60. The second portion 20 includes a speaker body 25 having a proximal end 30 and a distal end 40. The handle cable 70 is attached to distal end 60 of first portion 10 and a proximal end 30 of the second portion 20. Optionally and as shown, the handle cable 70 includes a gripping pad 80.

The speaker bodies 15, 20 of the first and second portions 10, 20, each include one or more speaker drivers disposed within the speaker body. A speaker driver transmits sound waves. The speaker drivers may be the same size or vary in size. The speaker drivers may range from 1.0, 1.5, 2.0, 2.5, 3.0, 3.5 . . . 10 inches, depending on the desired size of the speaker system.

Figure 5B:
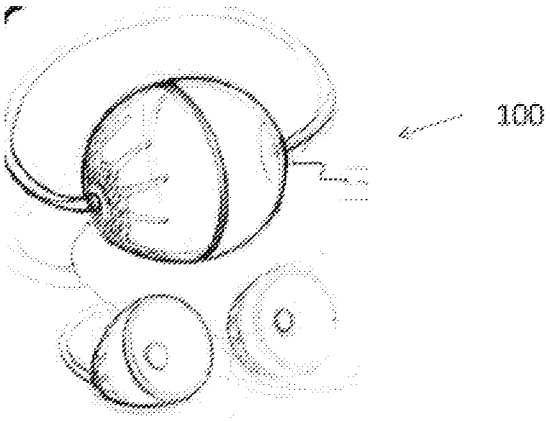
FIGS. 5A-5D illustrate different configurations of a first portion and second portion of a speaker system according to certain embodiments.
Figure 5D:
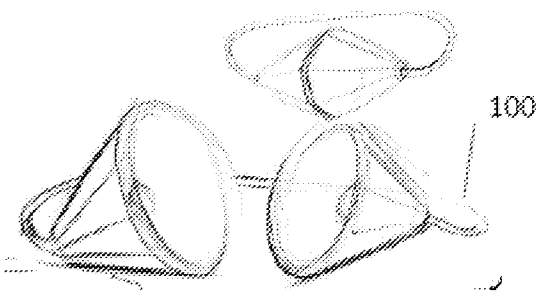
Figure 5A:
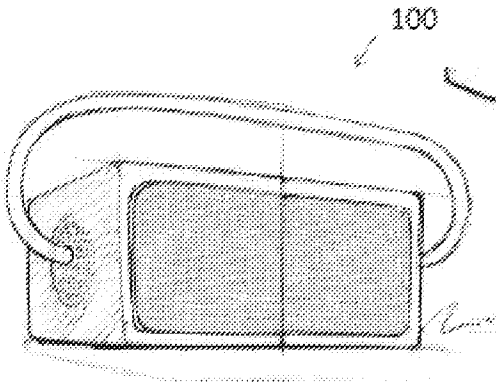
Figure 5C:
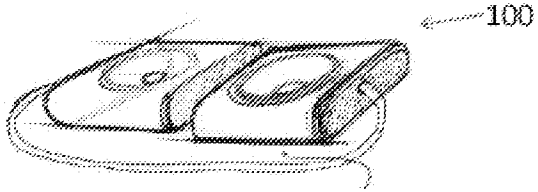

With the speaker drivers disposed within the first and second speaker body 15, 20, the speaker body 15, 20 acts to protect the speaker driver during transportation of the system 100. Alternatively, a speaker driver is partially disposed within a speaker body 15, 25 such that a portion of the speaker driver is exposed (as illustrated in FIG. 5C). The speaker bodies 15, 25 contain the mechanical and electrical components of the speaker system 100. The mechanical and electrical components of the speaker system 100 are described in more detail hereinafter in reference to FIG. 6. The speaker driver may be positioned anywhere within/on the speaker body. In certain embodiments, a speaker driver of the first portion 10 is positioned to transmit sound out of the distal end 60, and a speaker driver of the second portion 20 is positioned to transmit sound out of the proximal end 30. In such embodiment, the proximal end 30 and distal end 60 may be formed from a speaker grill. Although, the speakers may be arranged/positioned to transmit sound out of the opposite ends of the speaker bodies or out of a side of the speaker bodies. In addition, the positioning of one or more speaker drivers in a first portion may differ or be the same as the positioning of one or more speaker drivers in a second portion.

Particular speaker drivers suitable for use in methods of the invention include, high frequency compression drivers, low frequency drivers, high frequency drivers, and low midrange drivers. Suitable drivers include those manufactured by BMS Speakers GmbH (Hannover, Germany), FaitalPRO (Milan, Italy), and Vistaton (Germany).

Figure 4A:
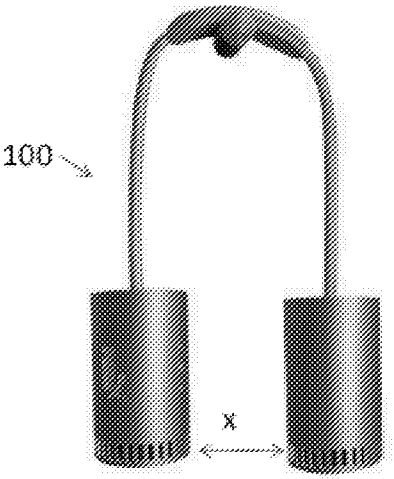
FIGS. 4A-4D illustrate various uses of the portable speaker system according to certain embodiments.
Figure 4B:
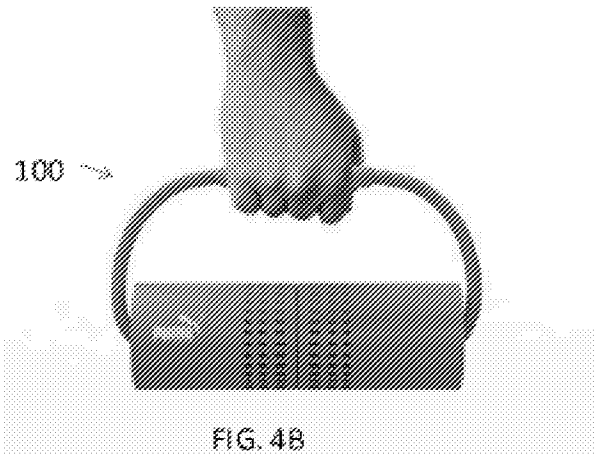

FIG. 1 depicts the speaker system 100 in a closed configuration. In the closed configuration, proximal end 50 of the first portion 10 couples to distal end 40 of the second portion 20. The proximal end 50 may be releasably coupled to distal end 40 using any suitable coupling. For example, with a press-fit coupling, screw-on coupling, etc. Preferably, the proximal end 50 is releasably coupled to the distal end 40 using magnets. Magnet couplings according to certain embodiments are described in more detail hereinafter. When the speaker system 100 is in a closed configuration, the first portion 10, second portion 20 and cable handle 70 formed a looped unit, as best shown in FIGS. 1 and 4B. This allows the speaker system 100 to enclose around an object and/or maintain a compact shape.

FIG. 2 depicts the speaker system in an open configuration. As shown in FIG. 2, the first portion 10 is separated from the second portion 20 by a distance X. The handle cable 70 is flexible, which allows the first portion 10 and second portion 20 to be placed in different positions. The ability to move the speaker system 100 from an open to a closed configuration allows a user to change placement of the first portion with the respect to the second portion. That is, the flexible handle allows the first portion 10 to be moved a distance X (see FIGS. 2, 4A, 4C) away from the second portion 20, thereby allowing movement of the first speaker driver away from the second speaker driver. This allows a user to arrange the first portion 10 with respect to the second portion 20 in order to enhance stereophonic, spatial sound as desired for a particular application. In addition, the convertible feature enhances portability of the device. For example, the speaker system can be attached to a backpack (FIG. 4D), hung on a hook (FIG. 4A), or carried while in compact form (FIG. 4B).

As shown in FIGS. 1 and 2, the speaker bodies 15, 25 of the first and second portions 10, 20 are cylindrical in shape. However, other shapes may be used for the first and second portions 10, 20. In non-limiting examples, the first and second portions 10, 20 may be shaped as a cube (FIG. 5A), low-profile rectangle (FIG. 5C), half-circles (FIG. 5B), or faceted (FIG. 5D).

Suitable material used to form speaker bodies 15, 25 may include a polymer, metal, or combination thereof. Suitable polymers include silicone, low density polyethylene, high density polyethylene, polypropylene, polystyrene, polytetrafluoroethylene, polyvinylchloride, polychorotrifuoroethylene, or combinations thereof. In one embodiment, the speaker bodies 15, 20 are a plastic shell with a silicone coating.

Suitable material used to form the handle cable 70 may include a polymer, metal, or combination thereof. A metal flexible handle cable 70 may be, for example, a spiral metal hose. A flexible polymer for the handle cable 70 may be, for example, silicone. The material of the handle cable 70 may be the same or different from the material of the speaker bodies 15, 25. The handle cable 70 should have sufficient flexibility to allow movement of the first portion away from the second portion, e.g. to transition the speaker system from the open configuration and closed configuration. In certain embodiments, the handle cable 70 is configured to hold electrical components that connect the first portion 10 to the second portion 20. This allows only one portion to include, for example, a battery, user interface components, Bluetooth connectivity component, and allows one portion to control and maintain the operation of the other portion. Alternatively, each speaker portion may each contain its own separate controls and components.

Figure 3:
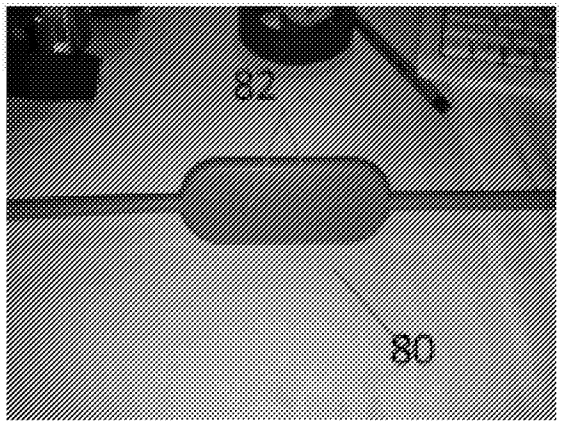
FIG. 3 illustrates a gripping pad according to one embodiment.
Figure 4C:
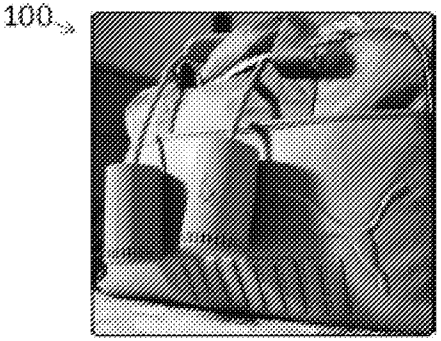
Figure 4D:
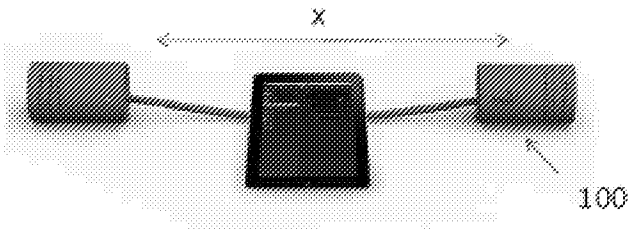

In some embodiments and as shown, the handle cable includes a gripping pad 80. The gripping pad 80 provides a grip for a user when holding the speaker system 100. The gripping pad 80 may include one or more anti-slip elements, as shown in FIG. 3. For example, the gripping pad 80 may include grooves or protrusions 82 to prevent slippage of a user's hand. The gripping pad 80 may also be used as a support surface for a media device being used with the speaker system 100, as shown in FIG. 4C.

In certain embodiments, the first portion 10, second portion 20, or both include one or more user interface components. As further shown in FIGS. 1 and 2, the first portion 10 includes a user interface panel 85. With the user interface panel 85, a user is able to, for example, turn on the speakers, turn up or down the volume of the speakers, and/or enable Bluetooth connectivity. In certain embodiments, the first portion 10, second portion 20, or both include one or more indicator elements. The indicator elements may be placed anywhere on the speaker bodies 10, 20. The indicator elements alert the user regarding a status of the speaker system. The indicator element alerts the user to convey a status of the speaker system 100. For example, the indicator element may alert the user as to a battery/charge level, whether the speaker is on, and a status of the Bluetooth technology. According to certain embodiments, the indicator element is a light element 85. The light element 85 may change colors to indicate a particular status. The light element 84 may be a light emitting diode (LED). In one embodiment, the light element is a logo of the speaker system.

In certain embodiments, the light element is provided on the first circuit board 11 and used for indicating the operating state of the speaker. (See e.g. FIG. 11) Further, a light transmitting plate 113 and a plastic panel 114 are provided at the side of the first circuit board 11 facing towards the LED lamp. The other side of the first circuit board 11 facing away from the LED lamp is electrically connected to the battery 12. Keys 15 are further connected to the first circuit board 11 and used for controlling and adjusting volume of the speaker.

Figure 6:
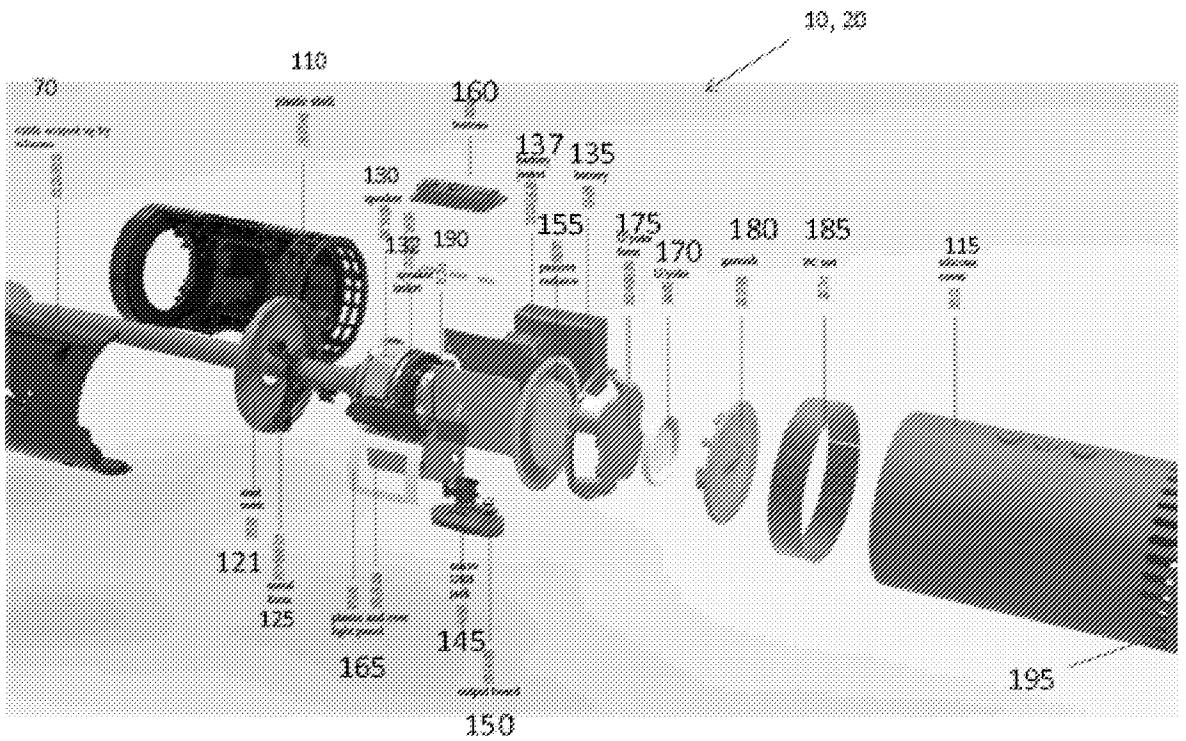
FIG. 6 shows an exploded view of the mechanical and electrical components of at least one of the speaker portions of the speaker system according to one aspect.

Referring now to FIG. 6, FIG. 6 shows an exploded view of the mechanical and electrical components of at least one of the speaker portions 10, 20 of the speaker system 100 according to one aspect. Each portion 10, 20 of the speaker system may have the same or different components. For example, one portion 20 may include a battery and other electrical components, whereas the other portion does not. In such example, an conductive wire driven through the cable handle 70 will drive/power the speaker portion not containing the battery or electrical components. Typically, each speaker portion 10, 20 at least includes a speaker driver and a coupling magnet. The components of at least one speaker portion are described in more detail below.

In certain embodiments, a speaker body 15, 25 of speaker portions 10, 20 includes a shell 110 and optionally a cover 115. As shown in FIG. 6, the shell 110 is a plastic and the cover 115 is a silicone plastic, however it is understood that the shell 110 and the cover 115 may be formed from other materials. The plastic shell 110 provides structure for the speaker and protects the inner speaker components, such as the speaker driver 130, from damage. The cover 115 is typically a softer material the plastic shell that further acts to protect the speaker system. The cover 115 may absorb unwanted external pressures from affecting the speaker system. The speaker grill 120 forms an end of the portion that connects to the cable handle 70. The speaker grill 120 defines an opening for receiving the cable handle 70. The cable handle 70 includes one or more conductive wires, such as electrical wires, to connect this portion to the other portion. As shown, the cable handle 70 includes electrical wires disposed in a silicone coating.

Figure 9:
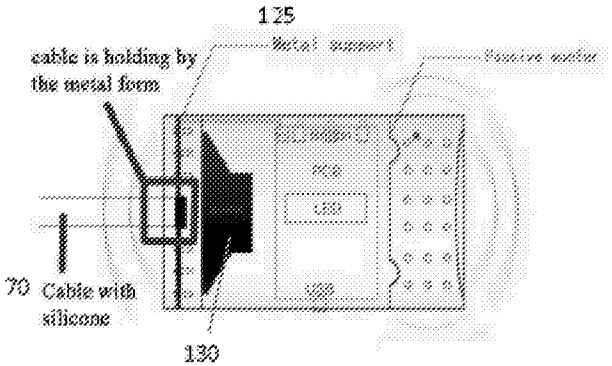
FIG. 9 illustrates a speaker holder form operably associated with the cable handle and speaker according to one embodiment.

As further shown in FIG. 6, a portion of the speaker system 100 includes a speaker holder form 125. The speaker holder form 125 may be metal or plastic. The speaker holder form 125 defines an opening for receiving the cable handle 70. The speaker holder form 125 acts to hold the speaker driver 130 and the cable handle 70 in place, as shown best in FIG. 9. The speaker driver 130 is positioned to transmit sound waves through the speaker grill 121. The speaker driver 130 is housed in a speaker jacket 132 to further maintain the positioning of the speaker driver 130 within the speaker body.

Any speaker driver may used to generate sounds for the speaker system. Although not shown in detail in FIG. 6, speaker driver components are described in more detail hereinafter. Typically, speaker drivers include a diaphragm that moves back and forth to create pressure waves in the air column in front, and depending on the application, at some angle to the sides. The diaphragm is typically in the shape of a cone for low and mid frequencies (cone-type driver) or a dome for higher frequencies (dome-type driver). Alternatively the diaphragm is a ribbon (ribbon driver). The diaphragm is usually made of coated or uncoated paper or polypropylene plastic. Other suitable materials include woven fiberglass, carbon fiber, aluminum, titanium, and a very few use PEI, polyimide, PET film plastic film as the cone, dome or radiator.

Speaker drivers typically have a means of electrically inducing back-and-forth motion. In certain embodiments, speaker drivers of the invention are battery powered, and include an in-unit rechargeable battery 135 (See FIG. 6). The rechargeable battery 135 is held in place with a battery jacket 137. Alternatively, the speaker system can be configured to use removable batteries. Typically, a tightly wound coil of insulated wire (known as a voice coil) is attached to the neck of the driver's cone. For ribbon speakers, the voice coil may be printed or bonded onto a sheet of very thin paper, aluminum, fiberglass or plastic. This cone, dome or other radiator is mounted to a rigid chassis, which supports a permanent magnet in close proximity to the voice coil. Typically and for efficiency, the relatively lightweight voice coil and cone are the moving parts of the driver, whereas the much heavier magnet remains stationary. Other typical components are a spider or damper, used as the rear suspension element, simple terminals or binding posts to connect the audio signal, and possibly a compliant gasket to seal the joint between the chassis and enclosure. Without limitation, speaker drivers are discussed in more detail in U.S. Pat. Nos. 4,348,549, 6,278,787, 6,704,425, 7,284,638, and 8,290,195 and U.S. Publication No. 2001/00054221 and 2004/0131219.

Optionally and as shown in FIG. 6, the speaker driver 130 is operably associated with a passive radiator 155. In one embodiment, the passive radiator 155 is mounted within the shell 110 of the speaker portion 10, 15 adjacent to the speaker driver 130 and facing the opposite direction, as exemplified in FIG. 8. For example, if the speaker driver 130 is facing a distal end of a speaker body, then the passive radiator 155 is positioned across from the speaker driver 130 and facing the proximal end of a shell 110 of the speaker body. Any passive radiator 155 may be used in speaker systems of the invention. However, other passive radiator 155 and speaker driver 130 configurations may be used. For example, the passive radiator 155 may be mounted next to the speaker driver 130 so that the passive radiator 155 and speaker driver 130 are facing the same direction.

Figure 7:
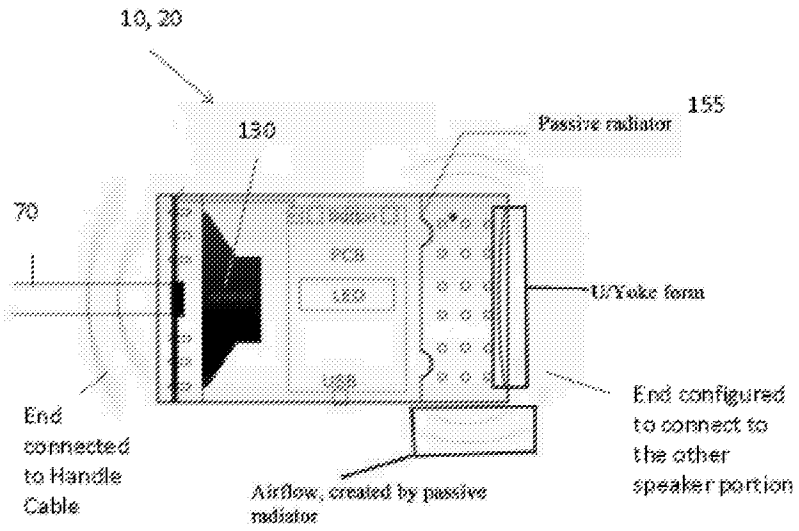
FIG. 7 depicts airflow leaving the speaker system from the passive radiator according to certain embodiments.

A passive radiator 155 is a device used to increase the low frequency response (Bass) of a speaker in order to improve sound quality. A passive radiator 155 is similar to a speaker driver 130, however it typically does not include electrical components (which makes it "passive" instead of "active"). Typically, a passive radiator 155 is a speaker cone, suspension, and frame. When a speaker driver 130 of the speaker system moves back and forth, the movement impacts the internal air pressure of the speaker body. This internal air pressure also causes the passive radiator 155 to move forward and backwards, thereby also creating sounds. Typically, a passive radiator emits sounds in low frequencies to increase Bass of a speaker system. Sound output from the passive radiator 155 can transmit, for example, from the sides of the plastic shell 110 and silicone cover 115. In certain embodiments, and as shown, the sides of plastic shell 110 and silicone cover 115 include one or more slits 195 (i.e. openings) to allow air and sound to escape from the speaker. In addition, a speaker grill or mesh 185 may be placed around the passive radiator. FIG. 7 depicts airflow leaving the speaker system 100 from the passive radiator 155. The passive radiator may be the same size or smaller than the speaker driver. The passive radiators may range from 1.0, 1.5, 2.0, 2.5, 3.0, 3.5 . . . 10 inches, depending on the desired size of the speaker system.

In certain embodiments, the passive radiator 155 is associated with a magnet 170 to increase sound amplification. Preferably, the magnet 170 associated with the passive radiator 155 is the same as the magnet 170 used to couple the first portion 10 to the second portion 20. In some embodiments, the passive radiator is coupled to one side of a magnet bracket 175 that accommodates the magnet 170.

When the elements of the speaker portion illustrated in FIG. 6 are assembled, a sealed space is formed among the diaphragm 155, the first circuit board 190 and the first loudspeaker 130, when the first loudspeaker 130 makes a sound, air vibration is excited by sound wave in the sealed space so that the diaphragm 190 of the first passive radiator is driven to generate bass resonance, the bass sound wave passes through the magnet bracket 175 and the magnet 170 and is reflected by the decorative cover 180 to result in an effect of bass rebound, therefore, the bass effect is emphasized. In this embodiment, the magnet 170 is an annular magnet which further increases the magnetic force. Hence, the holding force between the magnetically-first portion 10 and second portion 20 is improved after the speakers are coupled.

As discussed, a rechargeable battery 135 powers the speaker driver 130. The rechargeable battery 135 is positioned into place with a battery jacket 140. The rechargeable battery 135 is chargeable through a USB port 145. Any USB port 145 may be used. Preferably, the USB port 145 is a microport to conserve space. A USB connector can be introduced into the USB port 145 to provide power to the battery 135. The USB port 145 is held in an output board 150. The USB port may also be used to connect one or more media devices to the speaker system. This advantageously allows the speaker system 100 to convey sounds for wireless media devices and media devices without wireless capabilities (e.g. non-wireless communication devices).

As further shown in FIG. 6, a portion of the speaker system 100 includes a user interface panel 160 with one or more buttons. With the one or more buttons, a user can operate the speaker system 100. Through the user interface panel 160, the user can, for example, turn on the system, control volume, and control Bluetooth connectivity. In addition, the speaker system 100 includes an indicator element 165, which can be used to reflect a status of the speaker system 100. The indicator element 165 may be used to show the battery level, whether the system is on, or Bluetooth connectivity. The indicator element 165 may alert a user using flashing lights or different colored lights. In certain embodiments, the indicator element 165 is a light panel.

The user interface panel 160 is coupled to electronics 190 for enabling Bluetooth connectivity of the speaker system and enabling control of the speaker (i.e. turning on, adjusting volume, etc.). The electronics 190 are located on a printed circuit board and couple to electrical components of the speaker system 100, including battery 135, speaker driver 130, USB port 145, and indicator element 165. Printed circuit boards are commonly used within speaker systems to mechanically support and electrically connect electronic components located therein. Examples of printed circuit boards for use in speakers are described in U.S. Pat. Nos. 8,150,091 and 8,351,641.

In certain embodiments, the speaker system 100 may connect wirelessly to a media device using radio transmissions, e.g. Bluetooth technology. Any Bluetooth technology version is suitable for use with the speaker system. Preferably, the latest version of Bluetooth technology is incorporated into the speaker system for enhanced connectivity. An advantage of Bluetooth technology is that the user is able to listen to whatever is playing on the device connected to the speaker system, such as radio, movies, telephone calls, etc. According to some aspects, the speaker system 100 includes a microphone to allow the user to take and answer calls (connected via Bluetooth) with the built in microphone. Methods of establishing and designing Bluetooth connectivity devices are well known in the art. Speaker systems of the invention may also include, or be operably linked, to a wireless modem or wireless transmitter.

The battery, user interface panel, Bluetooth technology electronics and indicator element are typically only located on one of the portions 10, 20 of the speaker system. The first and second portions 10, 20 of the speaker system are connect via one or more conductive wires to allow communication between the two portions 10, 20.

As discussed, portions 10, 20 of the speaker system 100 each include a coupling element for coupling the first portion 10 to a second portion 20 of the speaker system 100. The coupling element allows the speaker system 100 to convert from an open configuration, in which a distance X separates the first and second portions, into a closed configuration, in which the first and second portions releasably couple together and form a looped unit. Preferably and as shown in FIG. 6, an end of a speaker portion, which is not coupled to the cable handle, is configured to releasably couple to an end of the other speaker portion with magnets. The speaker portion shown in FIG. 6 includes a magnet 170 placed on a magnet bracket 175. Ideally, this magnet 170 is also operably associated with the passive radiator as discussed above. The magnet 170 is configured to mate with a magnet of the other speaker portion (not shown in FIG. 6). A magnet cover 180 may optionally be placed over the magnet 170 for aesthetic purposes and to protect the magnet 170. The magnet 170 or magnet cover 180 may form at least a part of the end of the speaker portion.

Figure 10:
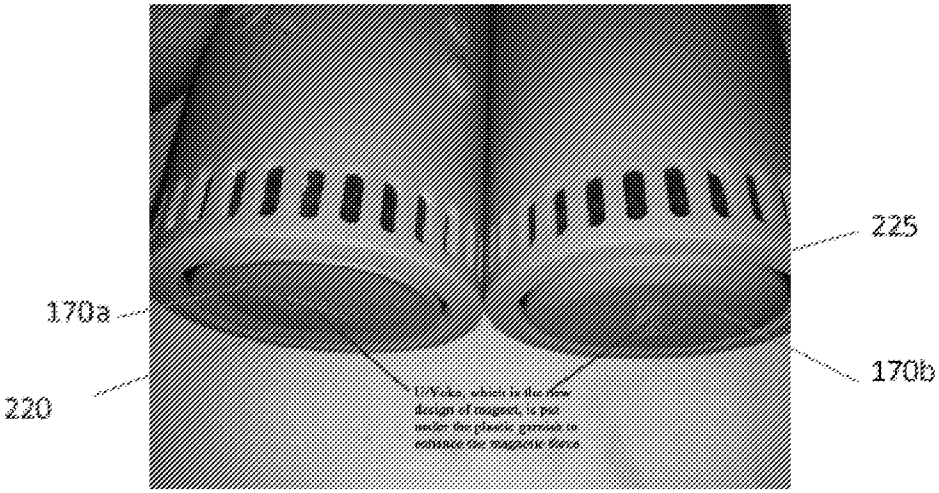
FIG. 10 illustrates coupling magnets for releasably coupling a first portion and a second portion of the speaker assembly according to certain embodiments.

In particular embodiments, the magnets 170 (and the corresponding magnet covers 180, if any) of each portion are designed to mate in an interlocking fashion. That is, a magnet 170 of the first portion 10 is designed to interlock with a magnet 170 of the second portion 20. In a preferred embodiment, the magnets 170 are designed to interlock via a U-yoke configuration. For a U-yoke configuration, one magnet 170*a* includes an indentation 220 on its surface, and the other magnet 170*b* includes a corresponding protrusion 225 on its surface (as shown in FIG. 10). The protrusion 225 of magnet 170*a* is configured to mate with the indentation 220 of the other magnet 170. This U-yoke configuration increases the strength of the magnetic coupling, which ensures that the speaker system 100 stays in the closed configuration when desired.

Figure 8:
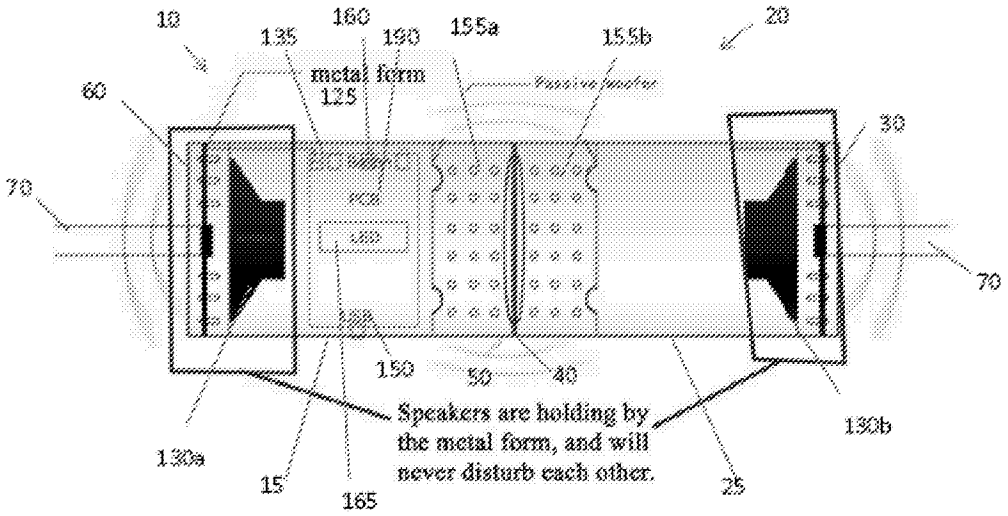
FIG. 8 depicts a cross-sectional view of the speaker assembly in a closed configuration.

FIG. 8 illustrates a cross-sectional view of two speaker portions 10, 20 coupled together in the closed configuration, thereby forming a looped unit with the first portion 10, second portion 20, and cable handle 70. As shown in FIG. 8, the speaker assembly includes a first portion 10 with body 15 coupled to a second portion 20 with body 25. Both the first portion 10 and the second portion 20 include a speaker 130*a*, 130*b* and a passive radiator 155*a*, 155*b*. The speaker 130*a* of the first portion 10 is positioned to emit sound towards a proximal end 60 of the first portion 10. The speaker 130*b* of the second portion 20 is positioned to emit sound towards a distal end 60 of the second portion 20. The speaker 130*a* of the first portion 10 is directly across from and facing the opposite direction of the speaker 130*b* of the second portion 130*b*. With this placement, the speakers 130*a*, 130*b* do not disturb or interrupt each other when in the closed configuration. A distal end 50 of the first portion 10 is coupled to a proximal end 40 of the second portion 20. The passive radiator 155*a* of the first portion 10 is located opposite of the speaker 130*a* in the first portion 10 and near the distal end 50. The passive radiator 155*b* of the first portion 10 is located opposite of the speaker 130*b* in the second portion 155*b* and near the proximal end. Preferably, the passive radiator 155*a* is facing the distal end 50 and the passive radiator 155*b* is facing the proximal end 40 in order to take advantage of the air flow passed by the speakers 130*a*, 130*b*. The sound waves emitted the speakers 130*a*, 130*b* and passive radiators 155*a*, 155*b* are indicated in FIG. 8. As also shown in FIG. 8, the first portion 10 contains the electronics 190, battery 135, indicator element 165, user interface panel 160 and USB port 150. It is understood that in an alternative design any one of more of these components may be placed in the second portion 20. The second portion 20 is connected to the first portion 10 via a conducting cable (not shown) running within and through the cable handle 70. The speaker system 100 may also be designed such that any one or more (or all) of the electronics 190, battery 135, indicator element 165, user interface panel 160 and USB port 150 are located on the second portion 20 instead of the first portion 10.

According to certain aspects, the speaker system of the invention may include voice-prompt programming and hardware to allow for control of the Soundchuck with voice commands. This programming may allow a user to, for example, turn on the speaker, activate Bluetooth technology, turn down or turn up the volume, and turn off the speaker. Voice-prompt programming and hardware for use with electronics includes a microphone, which is often referred to as a wireless digital audio link. The microphone for voice prompts may be the same as or different from the microphone used for phone calls (described above). The microphone includes filter technology to distinguish between conversational voice and the tone of a voice used to command the speaker system. This prevents inadvertent commands. Voice-prompt technology integrated into electronic devices is described in more detail in U.S. Publication Nos. 2011/031664, 2008/0317260, 2008/0215240, and 2004/0260549.

Figure 11:
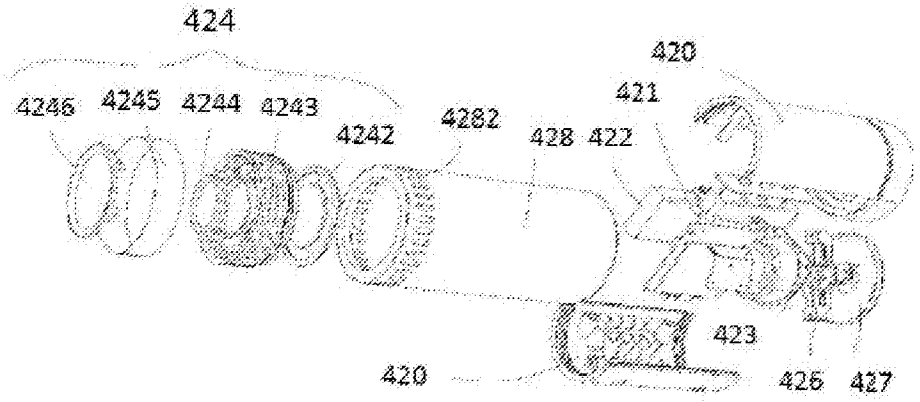
FIG. 11 is an exploded structural diagram of a main speaker for use with the auxiliary speaker shown in FIG. 12.
Figure 12:
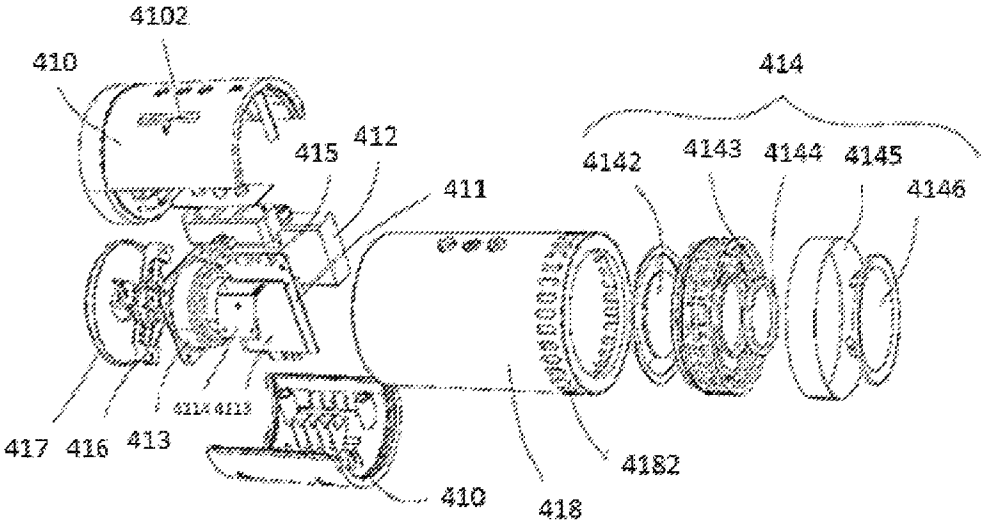
FIG. 12 is an exploded structural diagram of an auxiliary speaker for use with the main speaker shown in FIG. 11.
Figure 13:
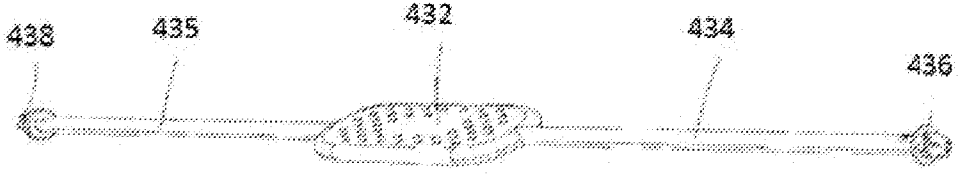
FIG. 13 is a structural diagram of the handle cable according to certain embodiments.

FIGS. 11-13 illustrates a preferred embodiment of the speaker system having a main speaker (i.e. first speaker portion) and its complementary an auxiliary speaker (i.e. second speaker portion).

Referring to FIG. 11 and FIG. 12, the multi-purpose portable speaker according to the utility model comprises a main speaker 401, an auxiliary speaker 402 and a handle cable 403, wherein the main speaker 401 and the auxiliary speaker 402 magnetically attract each other, the handle cable 403 is connected to the main speaker 401 and the auxiliary speaker 402, the main speaker 401 comprises a first shell 410, a first circuit board 411 provided in the first shell 410, a first battery 412 and a first loudspeaker 413, the first loudspeaker 413 is provided at one side of the first circuit board 411, a first passive radiation element 414 is provided at the other side of the first circuit board 411 and used for bass oscillation, the auxiliary speaker 402 comprises a second shell 420, a second circuit board 421 provided in the second shell 420, a second battery 422 and a second loudspeaker 423, the second loudspeaker 423 is provided at one side of the second circuit board 421, a second passive radiation element 424 is provided at the other side of the second circuit board 421 and used for bass oscillation, the second circuit board 421 receives an electronic audio signal transmitted by the first circuit board 411 via the handle cable 403, both sound directions of the first loudspeaker 413 and the second loudspeaker 423 face towards the handle cable 403, and the first passive radiation element 414 can be magnetically coupled to or separated from the second passive radiation element 424.

The first passive radiation element 414 comprises a diaphragm 4142, a magnet bracket 4143, a magnet 4144, an annular PC mesh 4145 and a decorative cover 4146 which are sequentially arranged. The diaphragm 4142 is provided relative to the first loudspeaker 413 and attached to one side of the magnet bracket 4143, the magnet 4144 is accommodated in the magnet bracket 4143, the annular PC mesh 4145 is sleeved on the magnet bracket 4143, and the decorative cover 4146 is covered on the magnet 4144. A sealed space is formed among the diaphragm 4142, the first circuit board 411 and the first loudspeaker 4413, when the first loudspeaker 4413 makes a sound, air vibration is excited by sound wave in the sealed space so that the diaphragm 4142 of the first passive radiation element 4414 is driven to generate bass resonance, the bass sound wave passes through the magnet bracket 4143 and the magnet 4144 and is reflected by the decorative cover 4146 to result in an effect of bass rebound, therefore, the bass effect is emphasized. In this embodiment, the magnet 4144 is an annular magnet which further increases the magnetic force. Hence, the holding force between the magnetically-attracted main speaker 401 and auxiliary speaker 402 is improved after the speakers are coupled.

Referring to FIG. 13 and according to certain aspects, the handle cable 43 comprises a handle part 432, a first pole part 434 and a second pole part 35, the first pole part 434 and the second pole part 435 symmetrically extend from two ends of the handle part 432, a first connecting head 436 is provided at the end part of the first pole part 434, and a second connecting head 438 is provided at the end part of the second pole part 435; and a first metal support 416 and a first steel mesh 417 are further provided between the first loudspeaker 413 and the handle cable 403, four angles of the first metal support 416 are fixed on the first loudspeaker 413, the first steel mesh 417 is covered on the first metal support 416, and the first pole part 434 of the handle cable 403 sequentially passes through an end face of the first shell 410 and the first steel mesh 417 and is fixedly clamped at the middle of the first metal support 416 via the first connecting head 436.

A second metal support 426 and a second steel mesh 427 are further provided between the second loudspeaker 423 and the handle cable 403, the four angles of the second metal support 426 are fixed on the second loudspeaker 423, the second steel mesh 427 is covered on the second metal support 426, and the second pole part 435 of the handle cable 403 sequentially passes through an end face of the second shell 420 and the second steel mesh 417 and is fixedly clamped at the middle of the second metal support 16 via the second connecting head 438.

In this embodiment, the handle cable 403 is a strip-shaped silicone line, a metal conducting wire (not shown in FIGS.) is provided in the handle cable 403, one end of the metal conducting wire extends from the first connecting head 436 and is electrically connected to the first circuit board 411, the other end of the metal conducting wire extends from the second connecting head 436 and is electrically connected to the second circuit board 421. Therefore, the main speaker 401 and the auxiliary speaker 402 are fixedly connected via the handle cable 403, and the connection of a left channel and a right channel (e.g. the main speaker and the auxiliary speaker are respectively the left channel and the right channel) of the speaker is further realized via the metal conducting wire provided in the handle cable 403.

To improve the performance of drop proof and water resistance of the speaker, a first silicone sleeve 418 is sleeved on the first shell 410 and adapted to the size of the first shell 410, and a second silicone sleeve 428 is sleeved on the second shell 420 and adapted to the size of the second shell 420. The first silicone sleeve 418 and the second silicone sleeve 28 serve the purpose of resisting and protecting against water.

A plurality of sound holes 4182 are formed at the end part of the first silicone sleeve 18 along the axis thereof and close to the first passive radiation element 414, and the bass sound wave of the first passive radiation element 414 can be transmitted out through the plurality of sound holes 4182 so that a favorable bass effect can be achieved.

Similarly, a plurality of sound holes 4282 are formed at the end part of the second silicone sleeve 428 along the axis thereof and close to the second passive radiation element 424, and the bass sound wave of the second passive radiation element 424 can be transmitted out through the plurality of sound holes 4282.

Moreover, the end portions of the first shell 410 and the second shell 420, the first loudspeaker 413, the second loudspeaker 423, the first passive radiation element 414 and the second passive radiation element 424 are all subjected to sealing processing for water resistant and dust proof, further enhancing and the water resistance and dust proof properties of the wireless Bluetooth speaker of the present invention.

The following directed to FIGS. 11 and 12 but is applicable to other embodiments described herein. When the multi-purpose portable speaker of the present invention is in use, the first circuit board 411 of the main speaker 401 receives the external audio electronic signal by the Bluetooth receiving module on the first circuit board 411, or the external interface 4102 directly inputs the audio electronic signal via the cable and generates audio signal current, a voice coil is subjected to force application and vibrates in a magnetic field while the audio signal current passes through the voice coil of the first loudspeaker 413 so that the first loudspeaker 413 is driven to emit sound, and the sound sent from the first loudspeaker 413 is transmitted out by an end face, close to the handle cable 403, of the first shell 410; at the same time, the audio electronic signal is transmitted to the second circuit board 421 of the auxiliary speaker 402 via the metal conducting wire in the handle cable 403, audio signal current is generated, a voice coil is subjected to force application and vibrates in the magnetic field while the audio signal current passes through the voice coil of the second loudspeaker 423, so that the second loudspeaker 423 is driven to make a sound, and the sound sent from the second loudspeaker 423 is transmitted out by an end face, close to the handle cable 403, of the second shell 420. Therefore, emission of sound by the left channel and the right channel of the multi-purpose portable speaker is achieved.

When the first loudspeaker 413 emits a sound, air vibration is excited by sound wave so that the diaphragm 4142 of the first passive radiation element 414 is driven to generate bass resonance. The bass sound wave passes through the magnet bracket 4143 and the magnet 4144 is reflected by the decorative cover 4146 and is finally transmitted out through the plurality of sound holes 4182 and the end part of the first silicone sleeve 418. The first passive radiation element 414 has function of bass rebound and a favorable bass effect is generated.

Similarly, when the second loudspeaker 423 emits a sound, air vibration is excited by sound wave so that the diaphragm 4242 of the second passive radiation element 424 is driven to generate bass resonance. The bass sound wave passes through the magnet bracket 41243 and the magnet 4244 is reflected by the decorative cover 246 and is finally transmitted out through the plurality of sound holes 282 and the end part of the second silicone sleeve 428. The second passive radiation element 424 also serves function of emphasizing the bass effect.

When the main speaker 401 and the auxiliary speaker 402 are magnetically attracted and coupled together during use, one end of the first passive radiation element 414 in the main speaker 401 is abutted with one end of the second passive radiation element 424 in the auxiliary speaker 402, and the main speaker 401 and the auxiliary speaker 402 are magnetically attracted to each other after coupling due to magnetic action of the magnet 4144 and the magnet 4142. As such, the bass sound waves generated from the first passive radiation element 414 and the second passive radiation element 424 are transmitted out through the plurality of sound holes in lateral faces of the silicone sleeves. Therefore, not only the speaker is guaranteed to operate normally and also has achieved excellent bass effect.

Therefore, the multi-purpose portable speaker according to the invention can be used in many manners, the main speaker and the auxiliary speaker can be magnetically attracted and coupled, or can be respectively suspended and moved. In the main speaker and the auxiliary speaker, the loudspeakers and the passive radiation elements are provided relatively, morphological characteristics of acoustic space and a cylinder are fully utilized and the favorable bass effect is achieved.

In conclusion, according to multi-purpose portable speaker of the present the invention, the structure of the speaker is simplified, yet alleviated the shortcomings of traditional speakers which the speakers cannot function if they are magnetically coupled to each other. Moreover, the bass effect is improved and the speaker is convenient to use and carry, while further offering the functions of water resistant, dust proof and drop proof.

References and citations to other documents, such as patents, patent applications, patent publications, journals, books, papers, web contents, have been made throughout this disclosure. All such documents are hereby incorporated herein by reference in their entirety for all purposes.

The invention may be embodied in other specific forms without departing from the spirit or essential characteristics thereof. The foregoing embodiments are therefore to be considered in all respects illustrative rather than limiting on the invention described herein. Scope of the invention is thus indicated by the appended claims rather than by the foregoing description, and all changes which come within the meaning and range of equivalency of the claims are therefore intended to be embraced therein.

The invention claimed is:

1. A speaker system, comprising a first speaker portion comprising a first speaker driver and including a first end and a second end;

a second speaker portion comprising a second speaker driver and including a third end and a fourth end; and a cable handle coupled to the first end of the first speaker portion and the third end of the second speaker portion, the cable handle comprising one or more conductive wires electrically coupling the first and second speaker portions to one another and configured to carry an audio electronic signal transmitted from one of the first and second speaker portions to the other, wherein the cable handle is configured to enable adjustment of a distance between the first speaker and the second speaker, the distance being selected to enhance stereoscopic, spatial sound for a particular application;

wherein the second end of the first speaker portion is configured to releasably couple to the fourth end of the second speaker portion, thereby forming an looped unit, when coupled, with the first speaker portion, the second speaker portion, and the cable handle.

2. The speaker system of claim 1, wherein the first and second speaker portions each comprise a coupling magnet for releasably coupling the first speaker portion to the second speaker portion.

3. The speaker system of claim 2, where the coupling magnet comprises a protrusion.

4. The speaker system of claim 2, wherein the coupling magnet comprises an indentation.

5. The speaker system of claim 1, wherein the first speaker driver and the second speaker driver transmit sound in opposite directions when the first speaker portion is coupled to the second speaker portion.

6. The speaker system of claim 5, wherein the first speaker portion, second speaker portion, or both comprise a passive radiator.

7. The speaker system of claim 1, wherein the speaker system communicates with a media device.

8. The speaker system of claim 7, wherein the speaker system wirelessly communicates with a media device using radio transmissions.

9. The speaker system of claim 1, wherein the first speaker portion, second speaker portion, or both comprise a shell for containing one or more speaker components.

10. The speaker system of claim 9, further comprising a cover for surrounding the shell.

11. A speaker system, comprising a first portion comprising a first speaker body and a first speaker driver disposed within the first speaker body, the first speaker body comprising a first distal end and a first proximal end;

a second portion comprising a second speaker body and a second speaker driver disposed within the second speaker body, the second speaker body comprising a second distal end and a second proximal end; and a cable handle coupling the first distal end of the first portion to the second proximal end of the second portion, the cable handle comprising one or more conductive wires electrically coupling the first and second portions to one another and configured to carry an audio electronic signal transmitted from one of the first and second portions to the other, wherein the cable handle is configured to enable adjustment of a distance between the first portion and the second portion, the distance being selected to enhance stereoscopic, spatial sound for a particular application;

wherein the first proximal end of the first portion releasably couples to the second distal end of the second portion, thereby allowing the speaker system to convert from an open configuration, in which the first portion is separated from the second portion by a first distance, to a closed configuration, in which the first portion, second portion, and handle cable form an looped unit.

12. The speaker system of claim 11, wherein the first and second portions each comprise a coupling magnet for releasably coupling the first portion to the second portion.

13. The speaker system of claim 12, where the coupling magnet comprises a protrusion.

14. The speaker system of claim 12, wherein the coupling magnet comprises an indentation.

15. The speaker system of claim 11, wherein the first portion, second portion, or both comprise a passive radiator.

16. The speaker system of claim 11, wherein the speaker system communicates with a media device.

17. The speaker system of claim 16, wherein the speaker system wirelessly communicates with a media device using radio transmissions.

18. The speaker system of claim 16, wherein the first portion, second portion, or both comprise a shell for containing one or more speaker components.

19. The speaker system of claim 18, further comprising a cover for surrounding the shell.

20. The speaker system of claim 19, wherein the shell, the cover, or both are formed from a polymeric material.

* * * * *